US008733552B2

(12) United States Patent
Ikeda

(10) Patent No.: US 8,733,552 B2
(45) Date of Patent: May 27, 2014

(54) CYLINDRICAL SIEVE AND CYLINDRICAL SIFTER

(75) Inventor: Yasuhiro Ikeda, Handa (JP)

(73) Assignee: Tsukasa Co., Ltd., Handa-Shi, Aichi (JP)

( * ) Notice: Subject to any disclaimer, the term of this patent is extended or adjusted under 35 U.S.C. 154(b) by 241 days.

(21) Appl. No.: 13/131,916

(22) PCT Filed: May 31, 2010

(86) PCT No.: PCT/JP2010/003629

§ 371 (c)(1),
(2), (4) Date: May 31, 2011

(87) PCT Pub. No.: WO2010/140336

PCT Pub. Date: Dec. 9, 2010

(65) Prior Publication Data

US 2011/0226676 A1 Sep. 22, 2011

(30) Foreign Application Priority Data

Jun. 5, 2009 (JP) ..... 2009-136383

(51) Int. Cl.
*B07B 1/18* (2006.01)

(52) U.S. Cl.
USPC ..... 209/288; 209/296; 209/397

(58) Field of Classification Search
USPC ..... 209/288, 293, 294, 296–300, 397
See application file for complete search history.

(56) References Cited

U.S. PATENT DOCUMENTS

| | | | | |
|---|---|---|---|---|
| 16,495 | A * | 1/1857 | Pollock | 209/270 |
| 71,099 | A * | 11/1867 | Weston | 209/293 |
| 4,236,999 | A * | 12/1980 | Burgess et al. | 209/240 |
| 4,339,043 | A | 7/1982 | Tice et al. | |
| 2006/0237347 | A1 | 10/2006 | Kato et al. | |
| 2008/0116120 | A1 | 5/2008 | Kato et al. | |
| 2008/0308469 | A1 | 12/2008 | Kato | |
| 2009/0020460 | A1 | 1/2009 | Kato et al. | |

FOREIGN PATENT DOCUMENTS

| | | | |
|---|---|---|---|
| DE | 202 14 115 | U1 | 3/2004 |
| EP | 1 743 711 | A1 | 1/2007 |
| GB | 1 571 678 | A | 7/1980 |
| JP | 48-68 | Y1 | 1/1973 |
| JP | 48-109163 | U | 12/1973 |
| JP | 53-109862 | U | 9/1978 |
| JP | 53-125668 | A | 11/1978 |

(Continued)

*Primary Examiner* — Joseph C Rodriguez
(74) *Attorney, Agent, or Firm* — Matthias Scholl, PC; Matthias Scholl

(57) ABSTRACT

An integrally-rotating cylindrical sieve 1 includes a hollow rotating shaft 2, which a driveshaft 21 is inserted into and fixed to, support members 3 radially extended from the rotating shaft 2, a cylindrical sieve body 4 made from a thin plate with a large number of apertures 5 formed therein, such as punching metal, and coupled with the support members 3, and sieve frames 6*a* and 6*b* attached to axial ends of the sieve body 4. The rotating shaft 2, the support members 3, the sieve body 4, the sieve frames 6*a* and 6*b*, and the driveshaft 21 are coaxially rotated together. The sieve body 4 is a cylindrical corrugated plate having wave crests and wave troughs arranged along its circumference and has a large number of apertures 5 formed in the corrugated plate. This arrangement improves the sieving efficiency of the granular material and effectively prevents potential destruction and cracking of the granular material, thus enhancing the commercial value of the sieved granular material.

4 Claims, 16 Drawing Sheets

(56) References Cited

FOREIGN PATENT DOCUMENTS

| | | | |
|---|---|---|---|
| JP | 60-95986 | U | 6/1985 |
| JP | 61-8488 | U | 1/1986 |
| JP | 2-9481 | A | 1/1990 |
| JP | 2-12487 | U | 1/1990 |
| JP | 9-220528 | A | 8/1997 |
| JP | 10-328505 | A | 12/1998 |
| JP | 11-47693 | A | 2/1999 |
| JP | WO2005/102543 | A1 | 11/2005 |
| WO | 02/38290 | A1 | 5/2002 |
| WO | 2004/060584 | A1 | 7/2004 |
| WO | 2007/129478 | A1 | 11/2007 |
| WO | 2007/129478 | A9 | 11/2007 |

* cited by examiner (a)

(b)

(a)

(b)

(a)

(b)

(a)

(b)

CYLINDRICAL SIEVE AND CYLINDRICAL SIFTER

CROSS-REFERENCE TO RELATED APPLICATIONS

This is a National Stage Application of International Patent Application No. PCT/JP2010/003629, with an international filing date of May 31, 2010, which is based on Japanese Patent Application No. 2009-136383, filed Jun. 5, 2009.

BACKGROUND OF THE INVENTION

1. Technical Field

The present invention relates to a cylindrical sieve and a cylindrical sifter, and more specifically to a technique of sieving various granular materials and powdery materials with the cylindrical sieve.

2. Background Art

A conventionally known cylindrical sieve generally includes a cylindrical sieve screen having square meshes as shown in Patent Literatures 1 and 2, rectangular meshes as shown in Patent Literature 3, or special polygonal meshes according to the applications as shown in Patent Literature 4.

There is, however, difficulty in sieving various granular materials in different shapes, such as cylindrical grains. Inclusion of any powder or agglomerate significantly lowers the commercial value of the sieved granular material. The granular material should thus be sieved while keeping the granulated shape. For example, grains or granules (e.g., soup stock grains) included in a food product, such as instant noodle, are generally produced by extrusion as brittle, long, cylindrical grains. The granular material formed in a certain shape do not so easily pass through the apertures of the sieve body, compared with the powder material. Sieving the granular material accordingly has the problem of difficulty in passage through the screen and the problem of the lowered commercial value due to the potential destruction or cracking of the grains stuck between the screen and a stirring member rotating in the screen. The effective measure to solve such problems is thus highly demanded. Using a stirring member is not preferable since the granular material may be damaged (destroyed or cracked) by the contact with the stirring member.

CITATION LIST

Patent Literature

Patent Literature 1: JU S60-95986

Patent Literature 2: IP WO2004/60584

Patent Literature 3: JP H11-47693

Patent Literature 4: JP H09-220528

SUMMARY OF THE INVENTION

Technical Problem

By taking into account at least part of the issue discussed above, there is a requirement for providing a cylindrical sifter that enables easy passage of various granular materials in different shapes and prevents potential destruction and cracking of granular material, so as to enhance the commercial value of the granular material.

Solution to Problem

In order to address at least part of the requirement described above, one aspect of the invention is directed to a cylindrical sieve including a cylindrical sieve body (4) made from a corrugated plate having wave crests and wave troughs arranged along its circumference, wherein a large number of apertures (5) are formed in the corrugated plate.

One preferable application of the invention is a cylindrical sifter (10) including a rotating shaft (2) and a support member (3) extended radially from outer circumference of the rotating shaft (2). The sieve body (4) is fastened to outer circumference of the support member (3) and causes sieved granular material to pass from an inner region (25) of the sieve body (4) to an outer region (26).

Another preferable application of the invention is another cylindrical sifter (200) including a rotating shaft (207*a*), a stirring member (207) extended radially from outer circumference of the rotating shaft (207*a*) to stir granular material, and a cylindrical sieve body (204) spaced apart from the stirring member (207) and fastened to a sieve housing. The stirring member (207) is rotated in the sieve body (204) and causes sieved granular material to pass from an inner region of the sieve body (204) to an outer region.

The corrugated plate is preferably a punching sheet, such as a metal sheet, a ceramic sheet, or a plastic sheet with a plurality of apertures formed therein. A screen net may also be employed for the corrugated plate.

Each of the apertures (5) may be formed in any of various shapes, such as an oval shape, a circular shape, or a star shape, according to the shape of the granular material as the sieving object. The oval shape is, for example, an elliptical shape. The sieve body (4) having a plurality of oval apertures (5) enables easy passage of cylindrical grains through the apertures (5) and has the enhanced sieving efficiency. The plurality of apertures (5) are preferably formed in the corrugated plate, such that the longitudinal axis of each of the apertures (5) is aligned in a preset direction. The preset direction may be, for example, a direction parallel to the axial direction of the rotating shaft (2) or a direction parallel to the circumferential direction of the sieve body (4). In one preferable arrangement, one array of the apertures (5) is shifted in position in the axial direction from an adjacent array of the apertures (5).

The cylindrical sifter may be an inline sifter or a non-inline sifter. The structure of the present invention is especially suitable for a sieve horizontally arranged in the sifter but may also be applicable to a sieve vertically arranged in the sifter.

Another aspect of the invention is directed to a double cylindrical sifter (100) including an upper or first-stage cylindrical sifter (110) and a lower or second-stage cylindrical sifter (150), where the upper cylindrical sifter (110) has a greater pore size of sieve apertures (115) than the pore size of sieve apertures (155) of the lower cylindrical sifter (150).

In one preferable structure of the double cylindrical sifter (100), the sieved granular material through the upper or first-stage cylindrical sifter (110) may be fed by a volumetric feeder (1116) into a granular material inlet (1511) of the lower or second-stage cylindrical sifter (150).

The cylindrical sieve and the cylindrical sifter of the present invention are not restrictively used for sieving granular materials but may also be used for sieving various powdery materials.

Effects of the Invention

Employing the corrugated plate for the sieve body increases the sieving area and generates the lifting-up force of the granular material, thus enhancing the sieving efficiency. The regularly arrayed formation of the large number of apertures in the corrugated plate helps alignment of direction of the grains and facilitates passage of the grains through the apertures, thus further increasing the sieving efficiency.

In the structure of the sieve body rotating with the support member, there is substantially no possibility that the granular material is stuck between the support member and the sieve body. This arrangement prevents potential destruction and cracking of various granular materials, such as cylindrical grains, and enhances the commercial value of the sieved granular material. In the structure of the corrugated sieve body with the stirring member rotating therein, the corrugated plate makes a space between the stirring member and the sieve body for receiving the grains. This arrangement lowers the potential for destruction of the granular material.

Employing the corrugated plate for the sieve body enables dispersion of the granular material. This leads to distribution of the load of the granular material in the sieve body and extends the service life of the sieve body.

DESCRIPTION OF THE EMBODIMENTS

Figure 1:
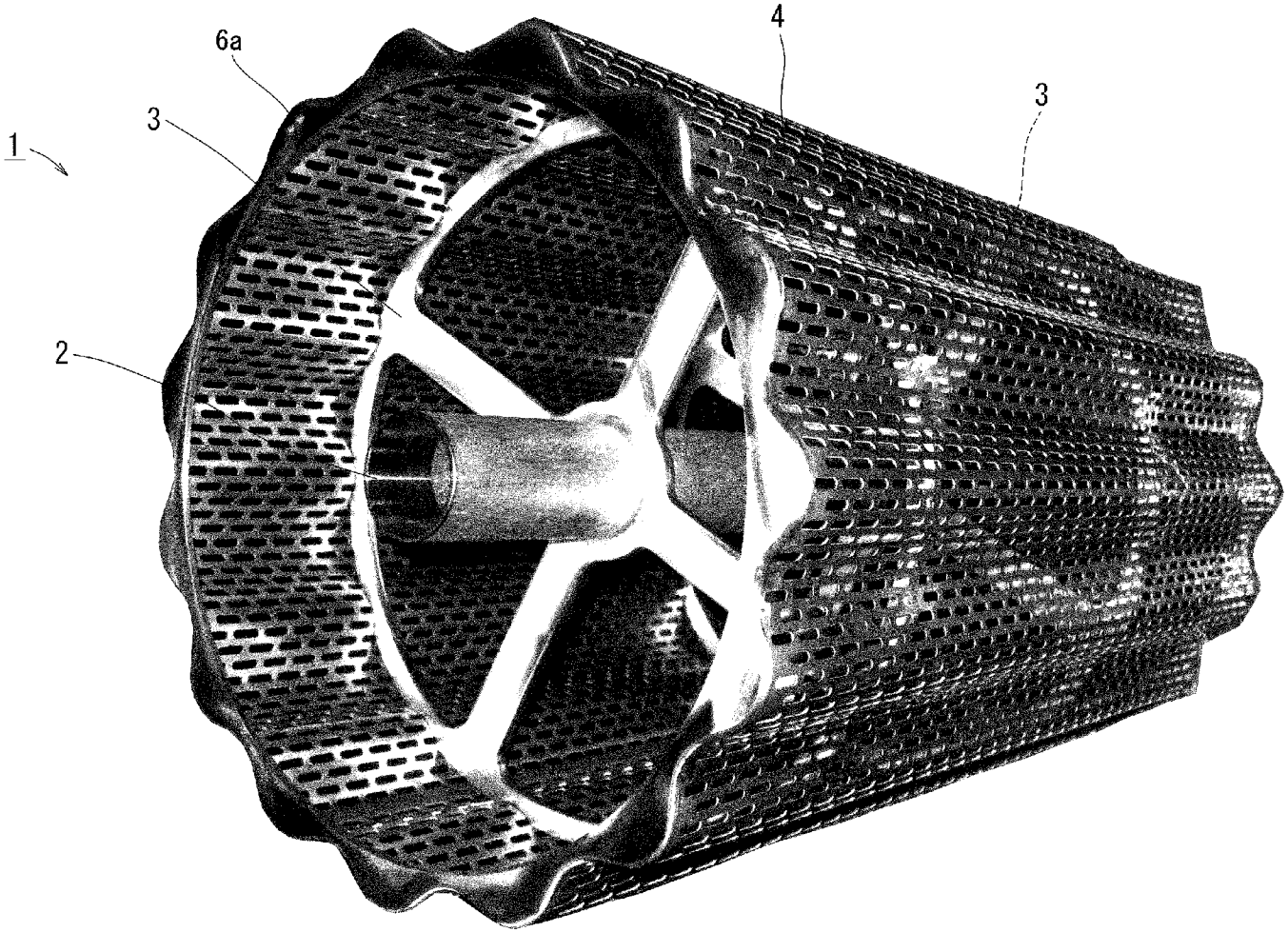
FIG. 1 is a perspective view of a cylindrical sieve in a first embodiment of the invention.

A cylindrical sieve 1 and a cylindrical sifter 10 according to one embodiment of the present invention are discussed below with reference to FIGS. 1 through 7.

As shown in FIGS. 1 through 4, the cylindrical sieve 1 has a rotating shaft 2, support members 3, a sieve body 4, and sieve frames 6*a* and 6*b*. The cylindrical sieve 1 is integrally rotated around the rotating shaft 2 with a driveshaft 21 (FIG. 5) inserted therein. The respective parts of the cylindrical sieve 1 are described in detail below.

Referring to FIGS. 1 through 4, the rotating shaft 2 is a cylindrical member extended in the axial direction and arranged on the center of the cylindrical sieve 1 and serves as a rotational center of the sieve body 4. Each of the support members 3 is located between the outer periphery of the rotating shaft 2 and the sieve body 4 and is radially extended inside the sieve body 4. The sieve body 4 is connected to the rotating shaft 2 by the support members 3 to be rotated integrally with the rotating shaft 2. In use of the cylindrical sieve 1, the cylindrical sieve 1 is fixed by inserting the driveshaft 21 into the rotating shaft 2. The method of such fixation will be described later.

Each of the support members 3 is extended radially from the rotating shaft 2 to be linked with the sieve body 4 to transmit the rotating force of the rotating shaft 2 to the sieve body 4. As shown in FIGS. 1 through 4, each of the support members 3 has a plurality of (four in the illustrated embodiment) plate arms 3*a* extended radially (four different directions at intervals of 90 degrees in the illustrated embodiment, but may be in any other suitable arrangement, for example, in three different directions at intervals of 120 degrees) from the rotating shaft 2, an inner ring 3*b* provided to connect the respective base ends of the plate arms 3*a* to the outer periphery of the rotating shaft 2, and an outer ring 3*c* provided along the inner circumference of the sieve body 4 to be connected to the respective extended ends of the plate arms 3*a*. The outer ring 3*c* is concaved in specific portions on the outer circumference interfering with respective wave troughs of the corrugated sieve body 4. The plate arms 3*a*, the inner ring 3*b*, and the outer ring 3*c* are made integrally from a plate member having the thickness direction parallel to the axial direction of the rotating shaft 2. A plurality of (two in the illustrated embodiment) the support members 3 are arranged at a preset interval in the axial direction to support the sieve body 4. In one preferable arrangement, the plate arms 3*a* are radially extended at equal intervals. This arrangement is, however, neither essential nor restrictive. For example, the plate arms 3*a* may be spirally extended from the rotating shaft 2 to the sieve body 4.

The sieve body 4 is a cylindrical corrugated plate having wave crests and wave troughs arranged along its circumference and has a large number of apertures 5 formed in the corrugated plate. The sieve body 4 is linked with the support members 3 to receive the rotating force transmitted from the rotating shaft 2. In the preferable embodiment, the sieve body 4 is formed in a regular corrugated shape having wave crests and wave troughs, which are regularly and alternately arranged along its circumference and continue in its axial direction, and substantially planar inclined areas on the boundaries between the wave crests and the wave troughs. The wave crests are combined with the concaved portions on the outer circumference of the outer ring 3*c* by welding or by any other suitable technique. The sieve body 4 is made from a metal plate, for example, a stainless steel plate or another iron plate and preferably has rigidity and elasticity, however, may have flexibility. One preferable method of providing the cylindrical sieve body 4 rings a corrugated metal plate with a large number of apertures 5 and welds the facing ends together to form the cylindrical sieve body 4.

Figure 3:
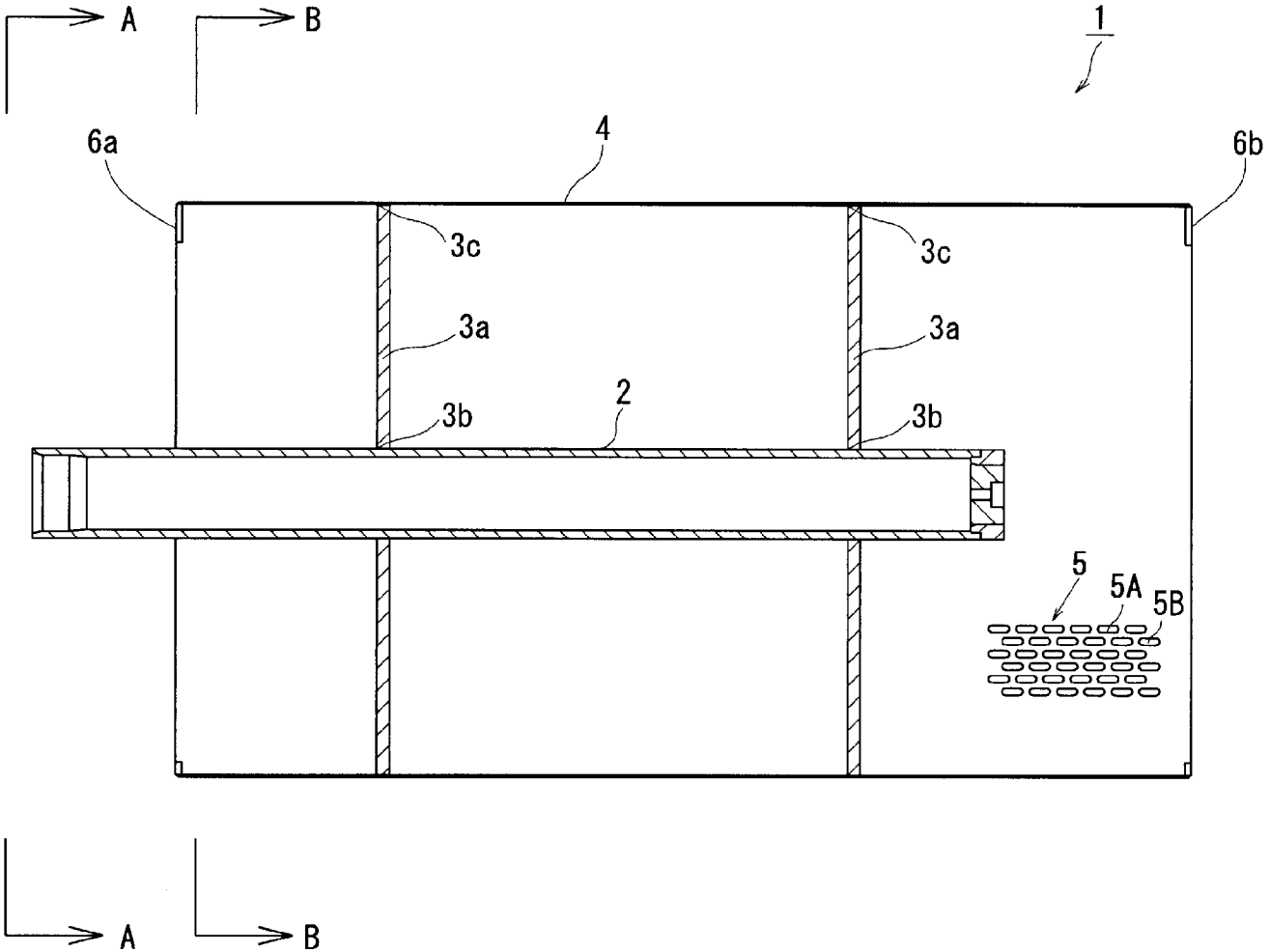
FIG. 3 is a partly-sectional front view of the cylindrical sieve of the first embodiment.

In the preferable embodiment, each of the apertures 5 is formed in an oval shape as shown in FIGS. 1 and 3. The respective apertures 5 are preferably formed in an identical shape and in identical dimensions. The apertures 5 may be formed, for example, by perforation in the metal plate. In the preferable embodiment, the apertures 5 are formed evenly over the sieve body 4, except two axial ends of the sieve body 4 to which the sieve frames 6*a* and 6*b* are fastened for the strength requirement. The horizontal to vertical ratio of the apertures 5 is preferably in a range of 2:1 to 10:1. The sieve body 4 has an aperture ratio of 30 to 60%. For example, each of the apertures 5 has the vertical dimension of 3 to 3.4 mm (approximately 0.1 to 0.13 inches) and the horizontal dimension of 10 to 12 mm (approximately 0.4 to 0.47 inches). The distance between the central axes of the adjacent apertures 5 is 4 to 8 mm (approximately 0.2 to 0.3 inches) in the vertical direction and 13 to 15 mm (approximately 0.51 to 0.59 inches) in the horizontal direction. The metal plate of the sieve body 4 has the thickness of 0.5 to 1.5 mm (approximately 0.02 to 0.059 inches).

The apertures 5 are arranged such that the longitudinal axes of the respective oval apertures 5 are arrayed in the axial direction of the rotating shaft 2. One array 5A of the apertures 5 is shifted in position in the axial direction from an adjacent array 5B of the apertures 5 (FIG. 3).

Figure 2:
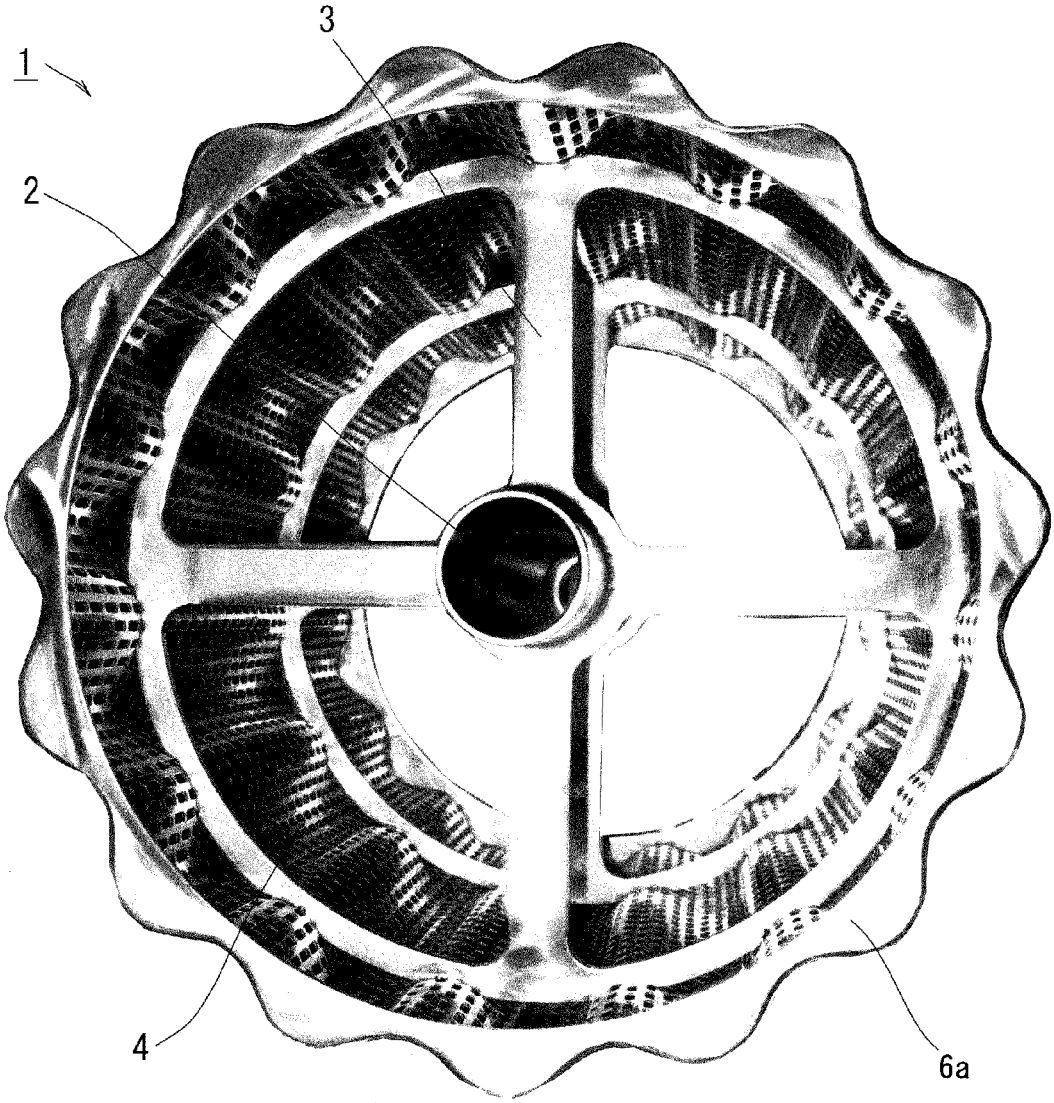
FIG. 2 is a perspective view of the cylindrical sieve of the first embodiment from another angle.
Figure 4:
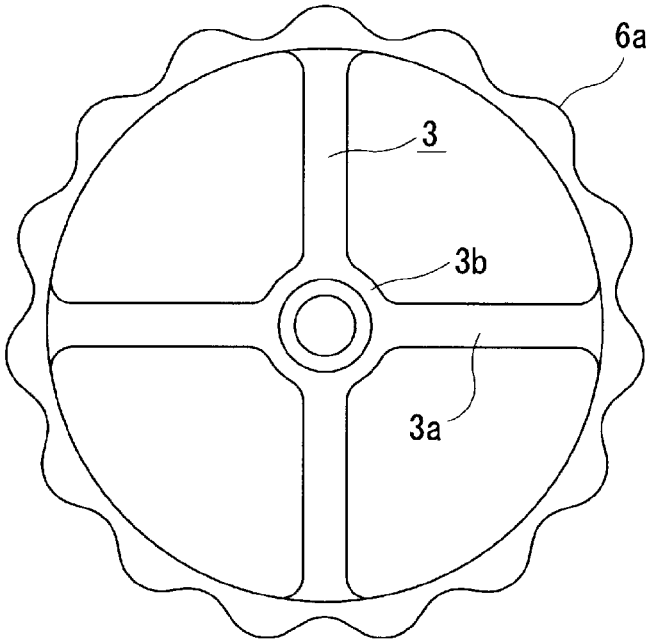
FIG. 4A is a left side view of the cylindrical sieve, taken on a line A-A in FIG. 3.
FIG. 4B is a cross section of the cylindrical sieve, taken on a line B-B in FIG. 3.
Figure 4:
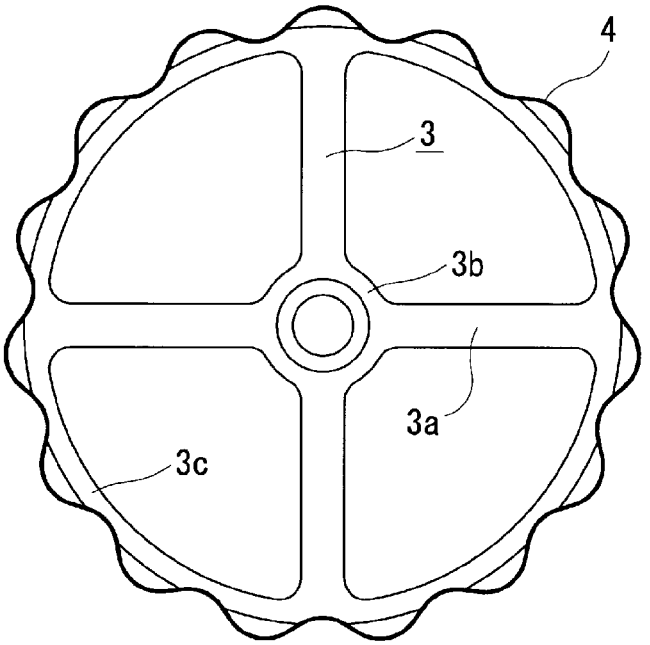

Referring to FIGS. 1, 2, and 4, the sieve frames 6*a* and 6*b* are ring-shaped plate members having the outer circumference conforming with the corrugated shape of the sieve body 4. The sieve frames 6*a* and 6*b* are mounted on the respective axial ends of the cylindrical sieve body 4. The sieve frames 6*a* and 6*b* have the thickness direction parallel to the axial direction of the rotating shaft 2. The sieve frames 6*a* and 6*b* may additionally be mounted in the middle of the axial length of the sieve body 4, in addition to the axial ends of the sieve body 4. The sieve frames 6*a* and 6*b* may have the smooth ring-shaped outer circumference, instead of the outer circumference conforming with the corrugated shape of the sieve body 4.

Figure 5:
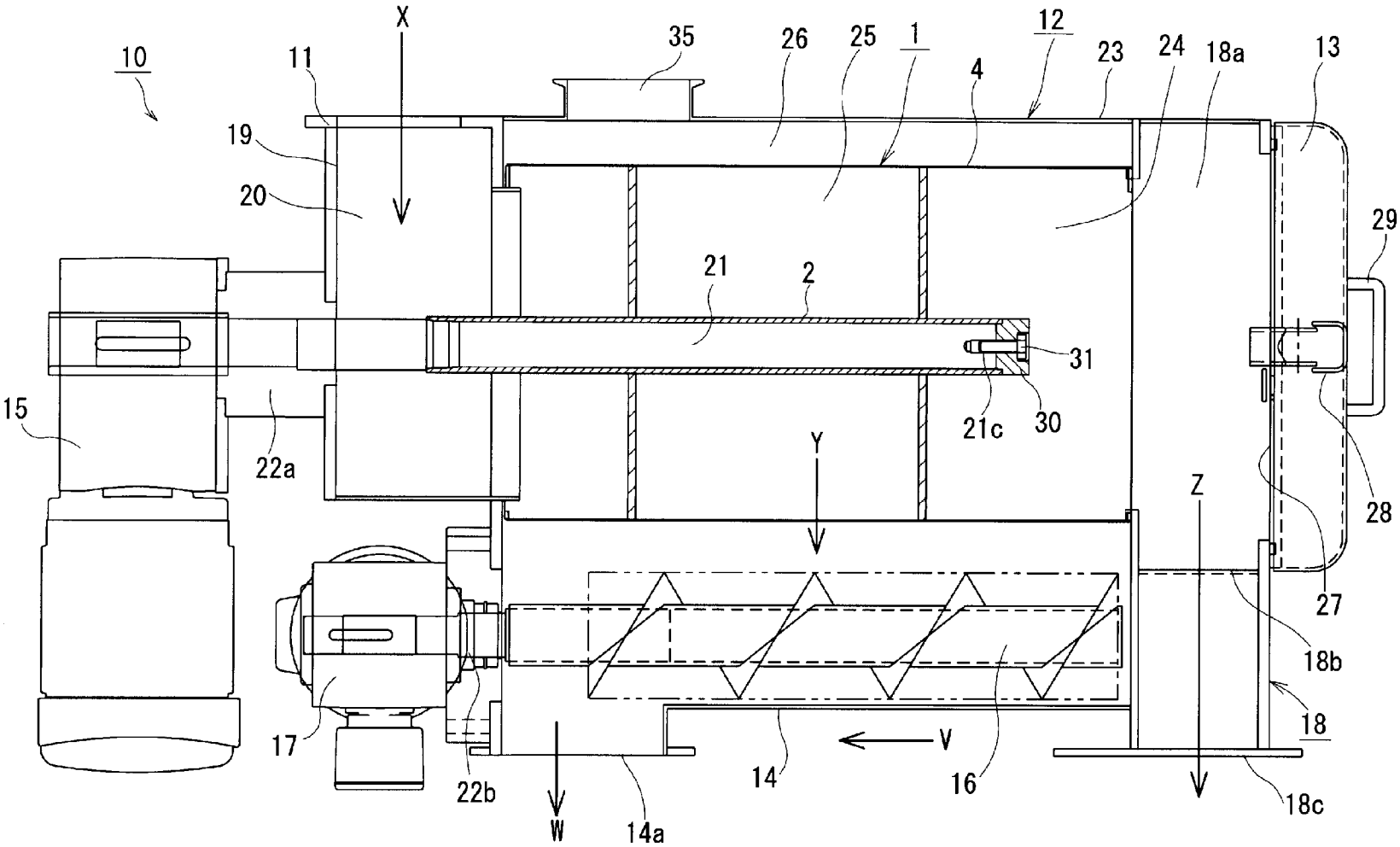
FIG. 5 is a partly-sectional front view of the internal structure of a cylindrical sifter with attachment of the cylindrical sieve of the first embodiment.

Referring to FIG. 5, the cylindrical sifter 10 has a granular material inlet 11, a supply casing 19, a sieve housing 23, a granular material outlet 14*a*, a non-sieved outlet 18*c*, and an inspection door 13. The cylindrical sieve 1 described above is located in the sieve housing 23. The respective parts of the cylindrical sifter 10 are discussed below.

The granular material inlet 11 is a round tube to receive grains or granular material supplied from an upstream line via a rotary valve or another valve (not shown). The granular material inlet 11 is connected with the supply casing 19.

The supply casing 19 includes a cylindrical supply chamber 20. The supply chamber 20 communicates with the granular material inlet 11 and a sieving chamber 24. The supply chamber 20 has a smaller capacity than the capacity of the sieving chamber 24.

The sieve housing 23 is arranged to cover over most of the cylindrical sifter 10. The inside of the sieve housing 23 is roughly divided into three sections, a sieving section 12, a sieved outlet section 14, and a non-sieved outlet section 18.

The non-sieved outlet 18*c* is provided in the downstream of the sieved outlet section 14 to discharge the non-sieved granular material from the cylindrical sifter 10.

The inspection door 13 is attached to a right side opening 27 of the sieve housing 23 and is opened to take out foreign matter from the sieve body 4 or to visually check the inside of the cylindrical sifter 10. The cylindrical sieve 1 may be replaced with a new one through the right side opening 27. The inspection door 13 is formed in a circular shape conforming with the axial end shape of the sieve housing 23. The inspection door 13 is coupled with the sieve housing 23 by means of a hinge (not shown) at one position along the circumference to be pivotally rotatable with the sieve housing 23 and is detachably attached to the sieve housing 23 by means of a sealing handle 28. The inspection door 13 has two handles 29 in its center region.

The sieving section 12, the sieved outlet section 14, and the non-sieved outlet section 18 inside the sieve housing 23 are discussed in detail below.

The sieving section 12 refers to the entire sieving assembly. The sieving section 12 has a reverse U-shaped side face and includes the sieving chamber 24, the driveshaft 21 arranged on the center of the sieving chamber 24 to be extended in the horizontal direction, the cylindrical sieve 1 set on the driveshaft 21 to be located in the sieving chamber 24, a sieve motor 15 provided to drive the driveshaft 21, and a bearing 22*a* arranged to support the driveshaft 21 in a rotatable manner.

The sieving chamber 24 has a double-cylindrical structure of an inner region 25 and an outer region 26 parted by the cylindrical sieve 1. The inner region 25 of the sieving chamber 24 communicates with the supply chamber 20, and the outer region 26 of the sieving chamber 24 communicates with the sieved outlet section 14.

The cylindrical sieve 1 is arranged to be freely rotatable in the sieving chamber 24. The cylindrical sieve 1 has an inner diameter that is slightly greater than the inner diameter of the outlet opening of the supply casing 19 and has a length that is slightly smaller than the length of the sieving chamber 24. The cylindrical sieve 1 has the structure discussed above in detail.

The sieved outlet section 14 is provided under the sieving section 12 to discharge the sieved granular material, which has been sieved through the sieve body 4, to a downstream line. The sieved outlet section 14 includes a volumetric feeder 16 provided to discharge the sieved granular material falling from the outer region 26, a discharge motor 17 provided to drive the volumetric feeder 16, and a bearing 22*b* arranged to support a rotating shaft of the volumetric feeder 16 in a rotatable manner. The most downstream end of the sieved outlet section 14 communicates with the granular material outlet 14*a*. A screw feeder is used for the volumetric feeder 16 in the illustrated embodiment.

Figure 6:
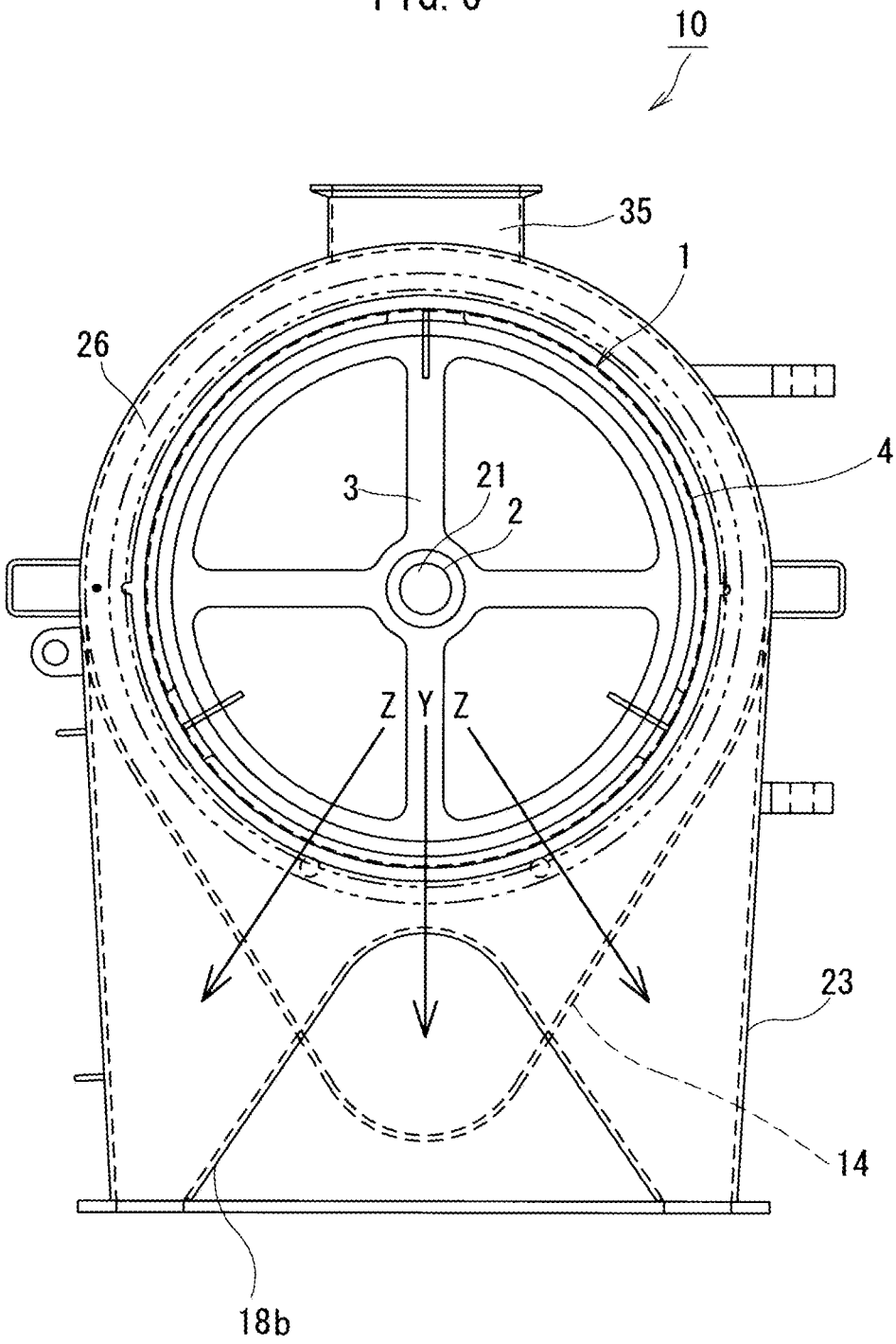
FIG. 6 is a right side view of the internal structure of the cylindrical sifter with omission of an inspection door.
Figure 7:
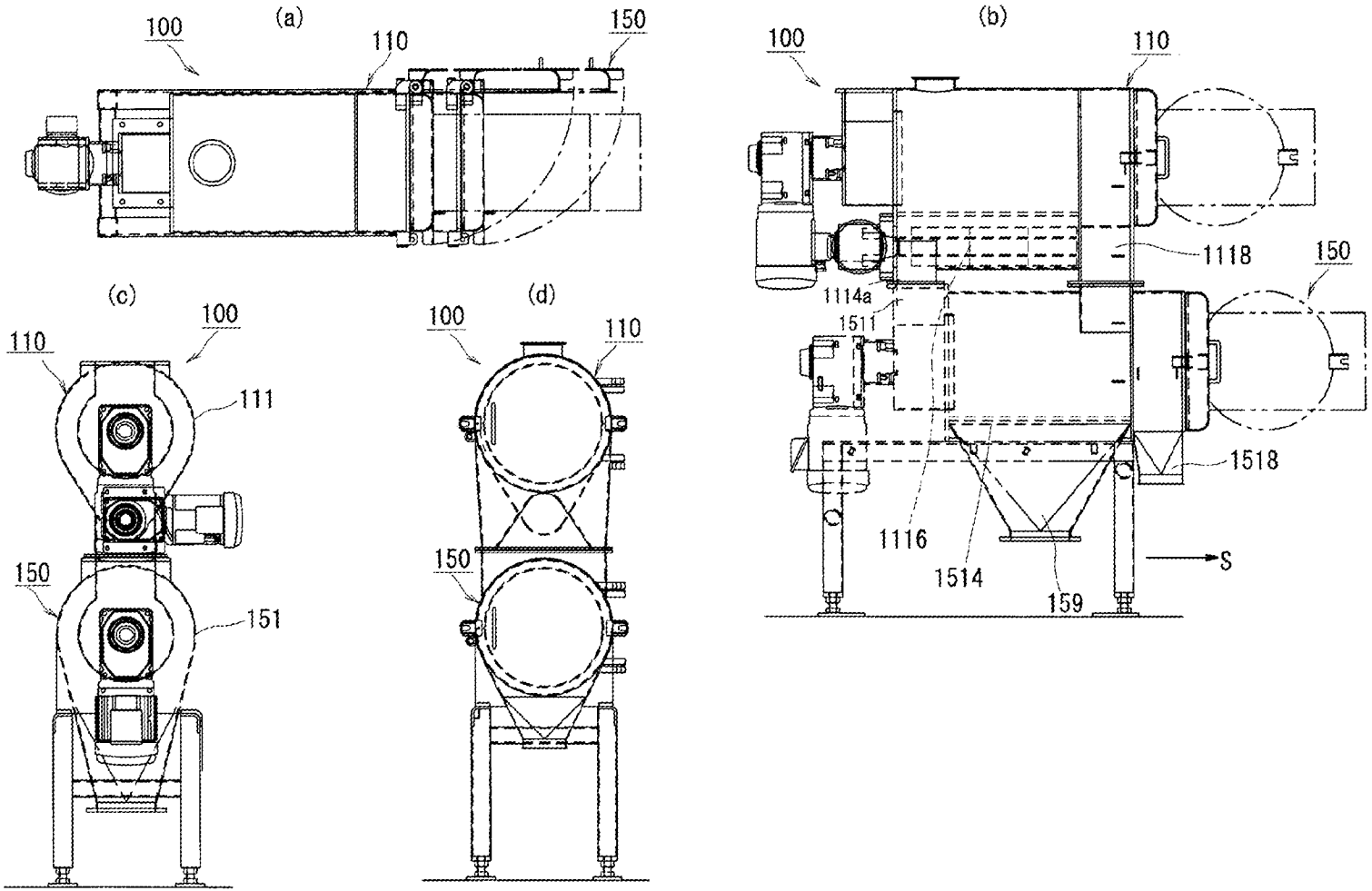
FIG. 7 is diagrammatic representations of the appearance and the internal structure of a double cylindrical sifter in a second embodiment of the invention.

The non-sieved outlet section 18 is provided to discharge the non-sieved granular material, which has not been sieved through the sieve body 4, to two separate downstream lines. The non-sieved outlet section 18 includes a non-sieved discharge chamber 18*a* communicating with the inner region 25 of the sieving chamber 24 and a non-sieved branching element 18*b* of a chevron side face (FIG. 6). The non-sieved branching element 18*b* has an outlet integrated with the non-sieved outlet 18*c*. The non-sieved branching element 18*b* may be a member of bifurcating the flow of the non-sieved granular material as shown in FIG. 6.

Each of the bearing 22*a* and the bearing 22*b* is provided as a cartridge unit including a labyrinth ring and an air purge (not shown).

The driveshaft 21 is in a cantilever structure extended to have a free end located close to a right end of the cylindrical sieve 1 inside the sieving chamber 24. The rotating shaft of the volumetric feeder 16 is also in a cantilever structure extended to have a free end close to one end of the sieved outlet section 14.

The cylindrical sifter 10 additionally has a bolt 31 and a fastener 30 to detachably fasten the cylindrical sieve 1. The cylindrical sieve 1 is fastened to the sieving chamber 24 by inserting the driveshaft 21 into the hollow center of the rotating shaft 2, fitting the fastener 30 on the end of the inserted driveshaft 21, and screwing the bolt 31 into a threaded hole 21*c* of the driveshaft 21 via the fastener 30 (FIG. 5). The tightening direction of the screw is set opposite to the rotating direction of the driveshaft 21, in order to prevent the loose screw.

A hole 35 may optionally formed on the sieving section 12.

The operations of the cylindrical sifter 10 of this embodiment are discussed below.

The cylindrical sifter 10 is assumed to be in-line arrangement for pneumatic conveyance. The cylindrical sieve 1 is attached in the cylindrical sifter 10 by inserting the driveshaft 21 into the hollow rotating shaft 2. While the cylindrical sieve 1 is attached, the sieve motor 15 is rotated to integrally rotate the driveshaft 21, the support members 3, the sieve body 4, and the sieve frames 6*a* and 6*b*. The granular material is continuously introduced through the granular material inlet 11 into the supply chamber 20 as shown by an arrow X in FIG. 5 and flows into the sieving chamber 24 to its inner region 25 inside the cylindrical sieve 1.

The granular material is moved from the supply chamber 20 toward the non-sieved discharge chamber 18*a* by pneumatic conveyance and is stirred and sieved by the corrugated surface of the sieve body 4 in the cylindrical sieve 1. It is preferable to rotate the cylindrical sieve 1 at low speed. The low-speed rotation causes the granular material to receive relatively small impact force from the sieve frames 6*a* and 6*b* and decreases the potential for destruction of the granular material. The fine sieved granular material, which has passed through the apertures 5 of the cylindrical sieve 1, is introduced through the outer region 26 to the sieved outlet section 14 as shown by an arrow Y in FIG. 5, is fed quantitatively by the volumetric feeder 16 as shown by an arrow V in FIG. 5, and is discharged through the granular material outlet 14*a* as shown by an arrow W in FIG. 5. The non-sieved granular material, which has not passed through the apertures 5 of the cylindrical sieve 1, on the other hand, is introduced from the inner region 25 into the non-sieved discharge chamber 18*a* and is discharged via the non-sieved branching element 18*b* through the non-sieved outlet 18*c* as shown by an arrow Z in FIG. 5.

During long-time sieving operation of the cylindrical sifter 10, some of the non-sieved granular material has not been introduced into the non-sieved discharge chamber 18*a* but has accumulated with foreign matter in the inner region 25. The operator visually checks the inside of the inner region 25 through an inspection window (not shown). When there is a requirement for removal of such accumulated material and matter, the operator stops the operation of the cylindrical sifter 10, loosens the sealing handle 28 of the inspection door 13, and opens the inspection door 13 with the two handles 29. The operator then removes the accumulated non-sieved granular material and foreign matter from the open sieving chamber 24. The inside of the cylindrical sieve 1 is cleaned in this manner. The cylindrical sieve 1 may be taken out of the sieving chamber 24 to be cleaned and may be returned to the position after cleaning.

The cylindrical sieve 1 is replaceable. A method of replacement untightens the bolt 31 and the fastener 30, pulls the driveshaft 21 out of the hollow rotating shaft 2, takes an old cylindrical sieve 1 out of the sieving chamber 24, and mounts a new cylindrical sieve 1 in the reverse order.

The rotating directions of the driveshaft 21 and the volumetric feeder 16 may be set arbitrarily. The cylindrical sieve 1 may have any of various fastening structures, for example, a cantilever structure or a center impeller structure.

The structure of the embodiment has the advantages and effects discussed below.

In the cylindrical sieve 1 and the cylindrical sifter 10 of the first embodiment described above, the corrugated sieve body 4 has the increased sieving area and the increased sieving effect. The oval apertures 5 decrease the potential interference with smooth passage of long grains or cylindrical grains as the sieving object at any angular relation to the apertures 5. The cylindrical grain in a lying position as well in a standing position can pass through the aperture 5. This increases the sieving efficiency. The regularly arrayed formation of the apertures 5 in the corrugated plate rectifies the flow of the granular material or grains to align the flow direction of the grains and facilitates passage of the grains through the apertures 5, thus further increasing the sieving efficiency. The cylindrical sieve 1 has the sieve body 4 integrally rotating with the support members 3. There is substantially no possibility that the grains are stuck between the support members 3 and the sieve body 4. This arrangement effectively prevents potential destruction and cracking of the granular material and thereby enhances the commercial value of the sieved granular material.

Figure 14:
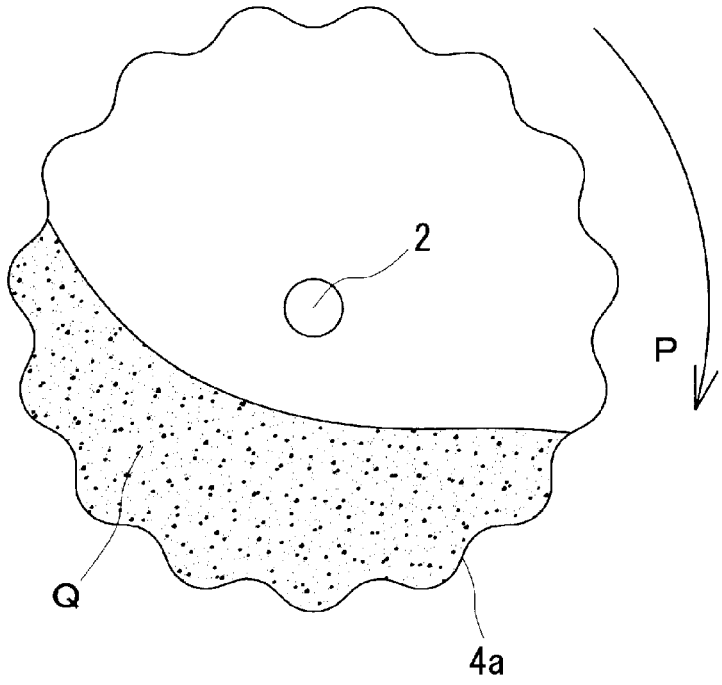
FIG. 14A is a diagrammatic representation of the state of granular material in a sieve body of the invention.
FIG. 14B is a diagrammatic representation of the state of granular material in a conventional sieve body.
Figure 14:
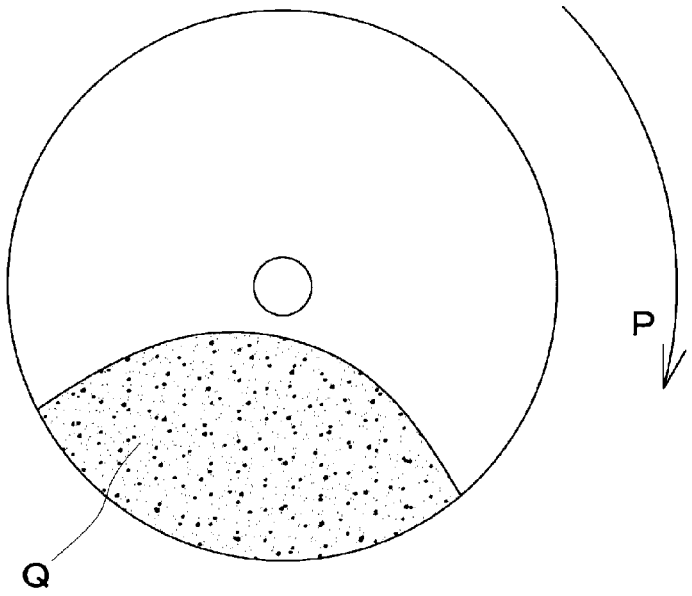
Figure 15:
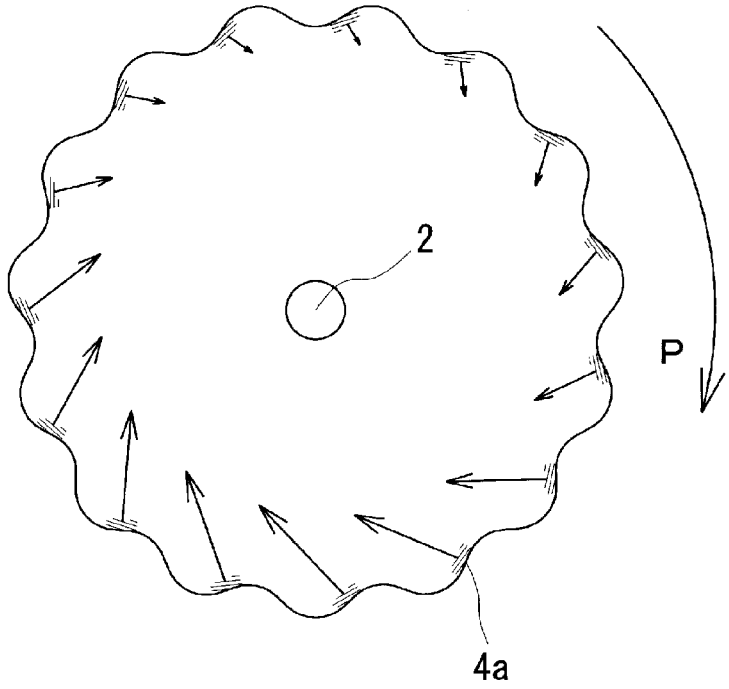
FIG. 15A is a diagrammatic representation of the forces applied to the granular material in the sieve body of the invention.
FIG. 15B is a diagrammatic representation of the forces applied to the granular material in the conventional sieve body.
Figure 15:
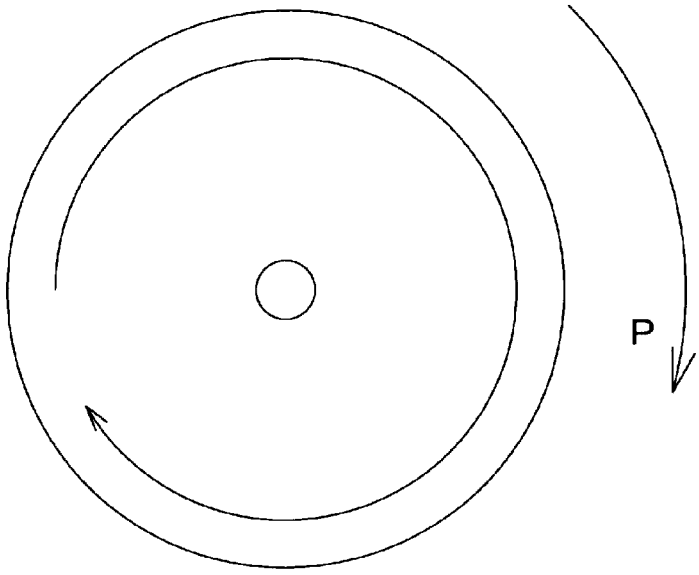
Figure 16:
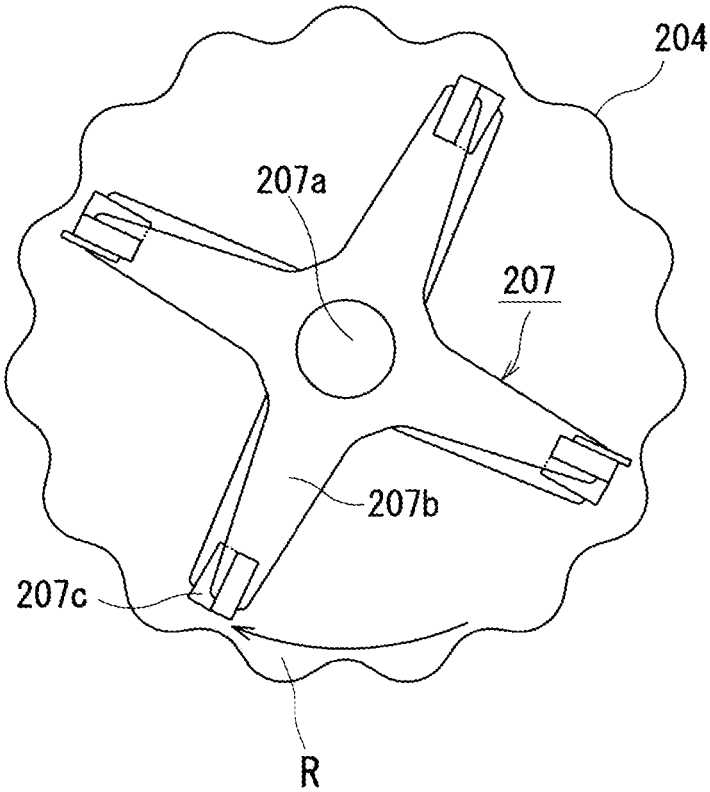
FIG. 16 is a diagrammatic representation of the relation of the granular material to a stirring member in a cylindrical sifter in one modification.

The enhanced sieving efficiency by the shape of the corrugated sieve body having wave crests and wave troughs is described in detail with reference to FIGS. 14 and 15. The operation of the sieve body 4 of the invention is explained with reference to FIG. 14. FIG. 14A is a diagrammatic representation of the grains in the sieve body 4 of the invention during rotation at a certain speed. FIG. 14B is a diagrammatic representation of the grains in a conventional cylindrical sieve body during rotation at the same certain speed for the comparison. As discussed above, there is a substantially planar inclined area of small curvature between the wave crest and the wave trough on the corrugated sieve body 4 of the invention. Each of the wave troughs is adjacent to two substantially planar inclined areas, where a rear inclined area in the rotating direction is shown as an inclined area 4*a* (FIG. 14A). The presence of the inclined areas 4*a* enhances the sieving efficiency as discussed below.

The conventional cylindrical sieve body shown in FIG. 14B has a smooth surface with no corrugation. It is assumed that the cylindrical sieve body is rotated in a direction P without any stirring member. The rotation of the conventional sieve body applies only the rotating force and the gravity to the granular material to have the limited stirring effect, or specifically limited stirring direction (FIG. 15B). This causes the granular material to be localized in a specific area Q during rotation in the direction P. Such localization decreases the contact area of the granular material with the surface of the sieve body and lowers the sieving efficiency and prevents the respective grains from passing through apertures formed in the sieve body with high efficiency. A stirring member may be used to stir and disperse the granular material. Using the stirring member in the conventional cylindrical sieve body of the smooth surface, however, causes the grains to be destroyed or cracked in the space between the sieve body and the stirring member as described above in "Background Art".

The sieve body 4 of the invention is described with reference to FIGS. 14A and 15A. As shown in FIG. 15A, since the wave crests and the wave troughs are alternately and regularly arranged on the corrugated sieve body 4, the rotation of the sieved body 4 applies a greater force onto the granular material than the rotation of the conventional sieve body shown in FIG. 15B. The corrugated surface of the sieve body 4 lifts up and moves the internal granular material during rotation of the sieve body 4 and has the increased screening area. This enables the internal granular material to evenly come contact with the surface of the sieve body 4 and enhances the sieving efficiency. The area Q in the sieve body 4 where the granular material tends to be localized during sieving is expanded from the area Q in the conventional sieve body as clearly shown by the comparison between FIG. 14A and FIG. 14B. During rotation of the sieve body 4 in the direction P, the lifted-up granular material is likely to hit against the inclined areas 4*a* in the sieve body 4. Some part of the granular material or grains passes through the apertures of the sieve body 4, while another part of the granular material or grains hits against the surface of the sieve body 4 to be bounced off and lifted up again. The combination of these motions enables the granular material to be stirred and sieved in the sieve body 4. The grains hitting against the inclined areas 4*a* are bounced off in the rotating direction of the sieve body 4 and in the direction toward the rotating shaft 2 to be moved spirally and sieved (FIG. 15A). The smooth surface of the conventional sieve body does not lift up or move the internal granular material during rotation of the sieve body and has the less screening area (FIG. 15B). This lowers the probability for the internal granular material to evenly come contact with the surface of the sieve body. The conventional sieve body accordingly has only the limited sieving efficiency.

The sieve body 4 of the invention applies the lifting-up force of the inclined areas 4*a* onto the granular material, in addition to the rotating force and the gravity applied by the conventional sieve body, thus making the complex motions of the granular material and having the good stirring effect. The complex motions of the granular material produce the regular spiral flow and thereby do not lower the sieving efficiency. The lifted-up granular material is mixed with the air and is dispersed in the sieve body to readily pass through the apertures of the sieve body. The sieve body 4 of the invention has the greater inner surface area than the conventional sieve body. The greater inner surface area and the complex motions of the granular material increase the contact area of the granular material with the surface of the sieve body to facilitate passage of the granular material through the apertures of the sieve body.

The sieve frames 6*a* and 6*b* have some effects as partitions on the granular material and accordingly prevent extreme localization of the granular material in one area. The presence of the sieve frames 6*a* and 6*b* has the advantageous effect on the sieving efficiency and prevents potential destruction and cracking of the granular material. The sieve frames 6*a* and 6*b* are integrated with the sieve body 4, so that there is substantially no possibility that the granular material is stuck between the sieve frames 6*a* and 6*b* and the sieve body 4.

As described above, the sieve body 4 of the invention has the significantly enhanced sieving efficiency, compared with the conventional sieve body. The excellent stirring effect of the sieve body 4 does not require a stirring member and thereby reduces the potential destruction and cracking of the granular material. A stirring member may, however, be used in combination with the sieve body of the invention as described later.

Replacement of the cylindrical sieve 1 with another cylindrical sieve of a different application enables any of various sieving objects other than the granular material to be sieved. The cylindrical sieve of the invention is thus applicable to a wide variety of sieving objects including the granular material.

The sieved granular material is quantitatively fed by the volumetric feeder 16 to the downstream line. This eliminates the potential irregularity in the downstream process and enables reduction of the total height of the cylindrical sifter 10.

In another preferable embodiment, two cylindrical sifters equivalent to the cylindrical sifter 10 discussed above may be provided in a vertical arrangement. A double cylindrical sifter 100 integrally accommodated in a common housing is discussed below with reference to FIG. 7. The double cylindrical sifter 100 includes an upper cylindrical sifter 110 and a lower cylindrical sifter 150. Corresponding parts and elements included in the sifters 110 and 150 are expressed by the like numerals to those discussed above with prefixes of "11" and "15", respectively.

The double cylindrical sifter 100 has the similar effects to those of the cylindrical sifter 10 discussed above and the additional effect of enabling classification of the granular material of middle grain size. The cylindrical sifter 110 excludes the non-sieved granular material, and the cylindrical sifter 150 excludes the double-sieved granular material, so that the single-sieved granular material of the middle grain size can be classified. This arrangement effectively removes powders and agglomerates from the granular material of the middle grain size and thereby enhances the commercial value of the granular material of the middle grain size.

The cylindrical sifter 150 basically has the same structure as that of the cylindrical sifter 110, except some differences. The apertures formed in the sieve body in the cylindrical sifter 150 have the similar shape but the smaller area than those in the cylindrical sifter 110. As shown by an arrow S in FIG. 7(*b*), a non-sieved outlet section 1518 of the cylindrical sifter 150 is shifted to be located at an outer position than a non-sieved outlet section 1118 of the cylindrical sifter 110. A granular material inlet 1511 of the cylindrical sifter 150 is connected with a granular material outlet 1114*a* of the cylindrical sifter 110. A hopper 159, instead of the volumetric feeder 16, is provided in a sieved outlet section 1514 of the cylindrical sifter 150.

The granular material as the sieving object of the double cylindrical sifter 100 is classified and discharged in three different grain size groups: non-sieved granular material of the large grain size from a non-sieved outlet 1118*c*; single-sieved granular material of the middle grain size from a non-sieved outlet 1518*c*; and double-sieved granular material of the small grain size from the hopper 159.

Each of a cylindrical sieve 111, a cylindrical sieve 151, and a volumetric feeder 1116 has arbitrary settings of rotating direction and rotation speed. In some sieving condition, it may be preferable to set opposite rotating directions to the respective cylindrical sieves of the cylindrical sifter 110 and the cylindrical sifter 150.

The double cylindrical sifter 100 of this embodiment basically has the same effects as those of the cylindrical sifter 10 discussed above. The double cylindrical sifter 100 has the additional effect of efficiently classifying and collecting the non-sieved granular material of the large grain size, the single-sieved granular material of the middle grain size, and the double-sieved granular material of the small grain size by using the two cylindrical sieves 111 and 151 having different screen sizes. The upper or first-stage cylindrical sifter 110 and the lower or second-stage cylindrical sifter 150 are connected with each other by the volumetric feeder 1116. There is accordingly no hopper between these two cylindrical sifters

110 and 150. This arrangement reduces the total height of the double cylindrical sifter 100. In the vertical arrangement of the two cylindrical sieves, the lower cylindrical sieve 151 serves as the safety net to trap pieces if the upper cylindrical sieve 111 is damaged, while the upper cylindrical sieve 111 shares the sieving load of the lower cylindrical sieve 150 and thereby prevents potential damage of the lower cylindrical sieve.

In another preferable embodiment, a rotary stirring member may be provided inside a fixed cylindrical sieve. A cylindrical sifter 200 including a cylindrical sieve 201 in place of the cylindrical sieve 1 discussed above and a stirring member 207 is discussed below with reference to FIGS. 8 and 9. The like parts and elements in the cylindrical sifter 200 to those in the cylindrical sifter 10 are not specifically described here. Corresponding parts and elements included in the cylindrical sifter 200 are expressed by the like numerals to those discussed above with a prefix "20".

The cylindrical sieve 201 has a sieve body 204 with a large number of apertures (not shown) and sieve frames 206*a* and 206*b* attached to respective axial ends of the sieve body 204. The sieve body 204 and the sieve frames 206*a* and 206*b* are respectively equivalent to the sieve body 204 and the sieve frames 6*a* and 6*b* discussed above. The cylindrical sieve 201 is fixed by a different technique from that employed for fixation of the cylindrical sieve 1 in the cylindrical sifter 10. Since the sieve body 204 is fixed in a non-rotatable manner, the support members 3 included in the cylindrical sifter 10 are omitted from the cylindrical sifter 200. The sieve frames 206*a* and 206*b* may be omitted as appropriate. The cylindrical sieve 201 is fixed in a non-rotatable manner by a sieve support 2037 provided on a sieve housing 2023. The sieve support 2037 has a shape of a flanged cylinder with a cylindrical part and a flange part around the outer circumference of the cylindrical part. The outer circumference of the cylindrical part of the sieve support 2037 serves to support and detachably fix the inner circumference of the cylindrical sieve 201. The stirring member 207 is set on a driveshaft 2021.

The stirring member 207 has a rotating shaft 207*a* set on the driveshaft 21 to be fixed, arms 207*b* radially extended from the outer circumference of the rotating shaft 207*a*, and blades 207*c* coupled with the arms 207*b*. Refer to the patent literature of WO2002/38290 for the detailed structure of this stirring member 207. Although the structure disclosed in this patent literature does not allow for replacement of a sieve, this embodiment is modified to allow for replacement of a sieve.

In the cylindrical sifter 200 of this embodiment, the stirring member 207 is rotated in an inner region 2025 of the cylindrical sieve 201 fastened to the sieve housing 2023 to facilitate sieving of the granular material. The structure of this embodiment uses the stirring member, in combination with the cylindrical sieve having the corrugated sieve body 204. In the conventional cylindrical sifter, there is a significant possibility that the granular material is stuck between the sieve body and the stirring member. In the cylindrical sifter 200 of this structure, however, the corrugated surface of the sieve body 204 makes a space R for receiving the granular material. There is thus very little possibility that the granular material is stuck between the stirring member 207 and the sieve body 204. The absence of the stirring member is generally preferable to prevent potential destruction and cracking of the granular material. The structure of the cylindrical sifter 200 is, however, effective for the applications that require the stirring member according to the size and the properties of the granular material or grains as the sieving object.

Figure 8:
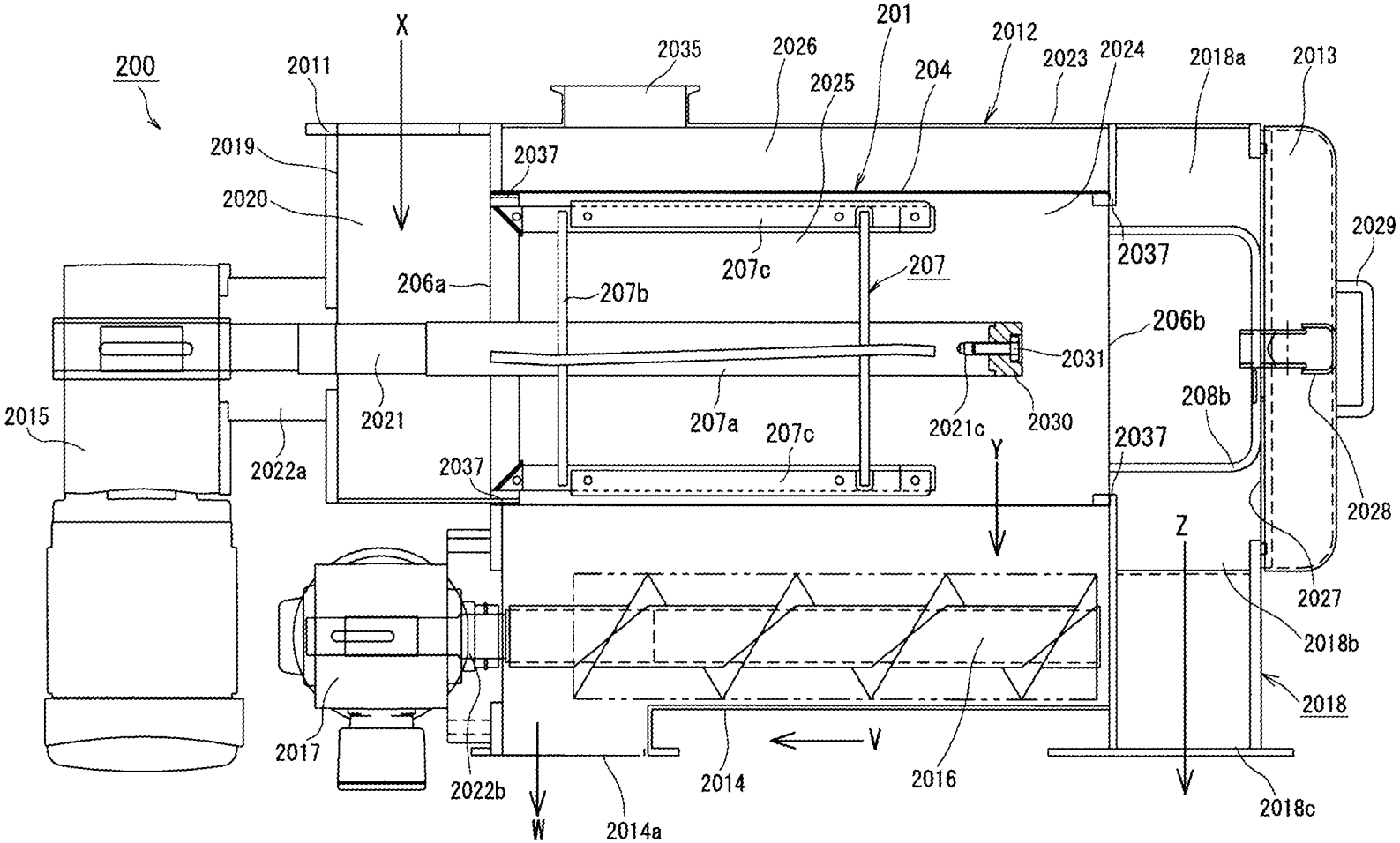
FIG. 8 is a partly-sectional front view of the internal structure of a cylindrical sifter in another embodiment of the invention
Figure 9:
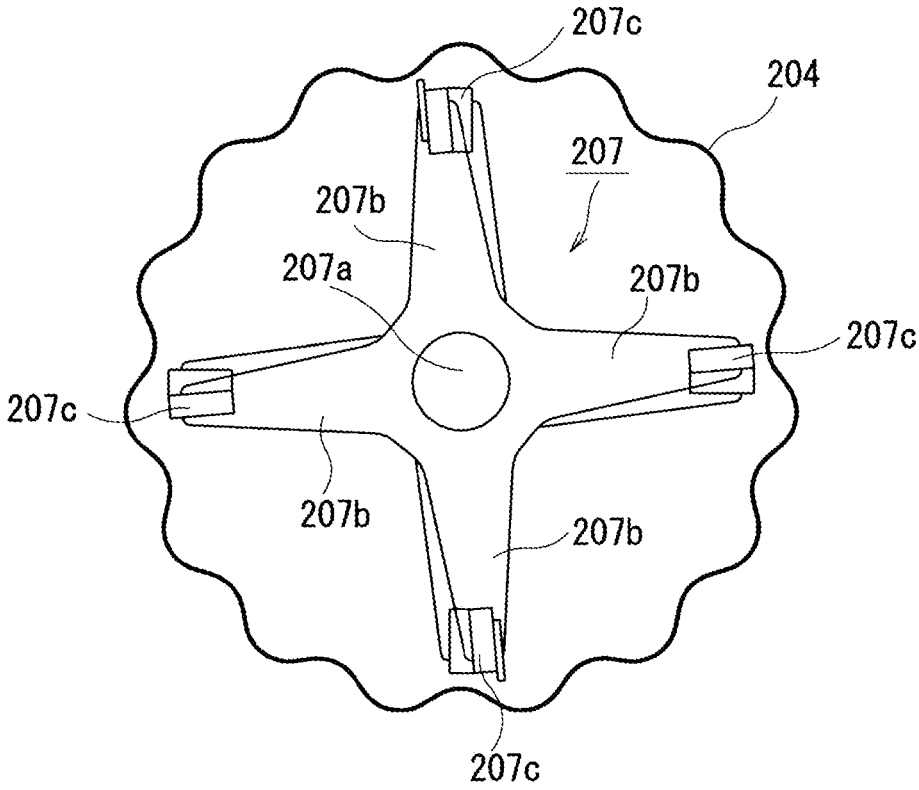
FIG. 9 is a right side view of a cylindrical sieve included in the cylindrical sifter of FIG. 8 with omission of sieve frames.
Figure 10:
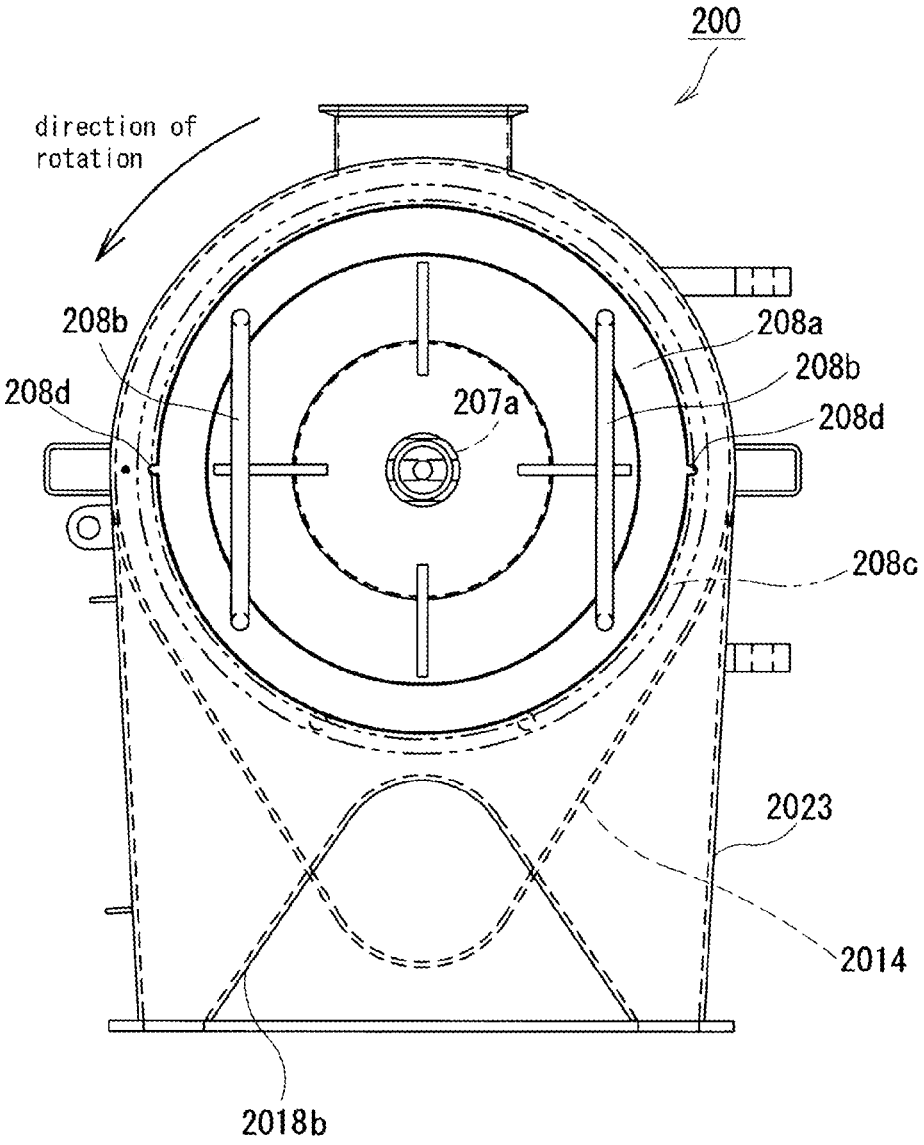
FIG. 10 is a right side view of the internal structure of the cylindrical sifter of FIG. 8 with omission of an inspection door.

In one preferable application of the cylindrical sifter 200, a frame rear end element 208*a* as a ring plate member is provided on the rear sieve frame 206*b* on the rear end of the sieve body 204, and handles 208*b* extended to the rear end of a non-sieved discharge chamber 2018*a* are attached to the frame rear end element 208*a* (FIGS. 8 and 10). In a closed state of an inspection door 2013, the inner wall of the inspection door 2013 presses the rear ends of the handles 208*b* to restrict the motion of the sieve body 204 in the axial direction. Male-female fitting elements 208*d* are provided on the frame rear end element 208*a* and on a ring body 208*c* fastened to the sieve housing 23. A plurality of the fitting elements 208*d* are arranged along the outer periphery of the ring body 208*c*. The fitting elements 208*d* radially facing each other restrict the rotation of the sieve body 204. The inspection door 2013 of this structure serves also to fix the cylindrical sieve 201. The large handles 208*b* facilitate detachment or removal of the sieve body 204 from the cylindrical sifter 200.

In one structure of the sieve body 204 without the sieve frames 206*a* and 206*b*, it is preferable to form the sieve support 2037 employed for supporting and fixing the sieve body 204 in a corrugated shape conforming with the corrugated surface of the sieve body 204 without any clearance. In another structure of the sieve body 204 with the sieve frames 206*a* and 206*b*, it is preferable to eliminate any clearance between the sieve support 2037 and the sieve frames 206*a* and 206*b*.

Removing the stirring member 207 from the cylindrical sifter 200 and replacing the cylindrical sieve 201 with the cylindrical sieve 1 makes the cylindrical sifter 200 identical with the cylindrical sifter 10. Sharing the remaining parts other than the cylindrical sieve and the stirring member has the cost-reducing effect and the space-saving effect. The outer diameter of the cylindrical sieve 1 should be set to be smaller than the outer diameter of the cylindrical sieve 201. Such setting makes a space between the sieve support 2037 and the rotating sieve body 204 to prevent the mutual interference.

The cylindrical sieve 1 may be replaced with the cylindrical sieve 201 according to the following procedure. For the convenience of explanation, the corresponding parts or elements are expressed by the numerals and symbols used for the cylindrical sifter 10 discussed previously. The procedure of replacing the cylindrical sieve 1 with the cylindrical sieve 201 untightens the bolt 31, detaches the fixture 30, pulls out the driveshaft 21 from the rotating shaft 2, and takes the cylindrical sieve 1 out of the sieving chamber 24. The procedure then inserts the driveshaft 21 into the rotating shaft 207*a* of the stirring member 207, attaches the fixture 30, tightens the bolt 31, inserts the cylindrical sieve 201, and fixes the cylindrical sieve 201 with the sieve support 2037. The cylindrical sieve 201 is replaced with the cylindrical sieve 1 according to the reverse procedure.

The cylindrical sieve 201 is fixed in a non-rotatable manner in the cylindrical sifter 200. The non-rotatable fixation is, however, not essential, but the cylindrical sieve 201 may be fixed in a rotatable manner. Such flexibility for rotation does not reduce the advantages of the corrugated sieve body but has contribution to the diversified applications of the sieving operation. In the rotatable arrangement, it is preferable to employ a separate driveshaft from the driveshaft 21 and a separate motor to drive the cylindrical sieve 201 independently of the stirring member 207.

Figure 11:
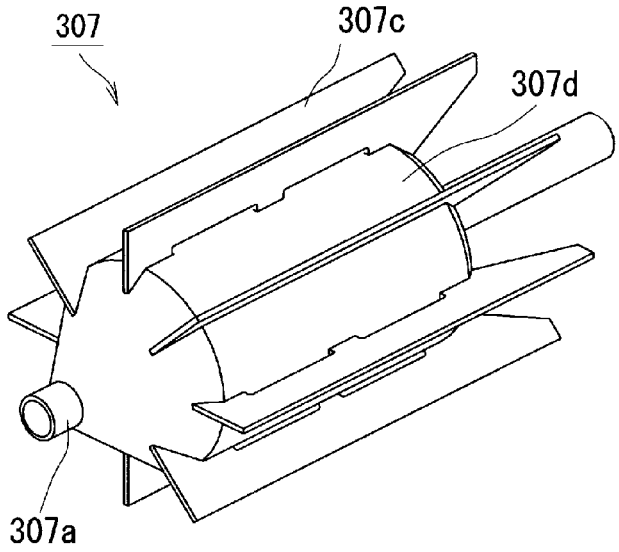
FIG. 11 is perspective views of a modified example of a stirring member employed in the cylindrical sifter of FIG. 8.
Figure 11:
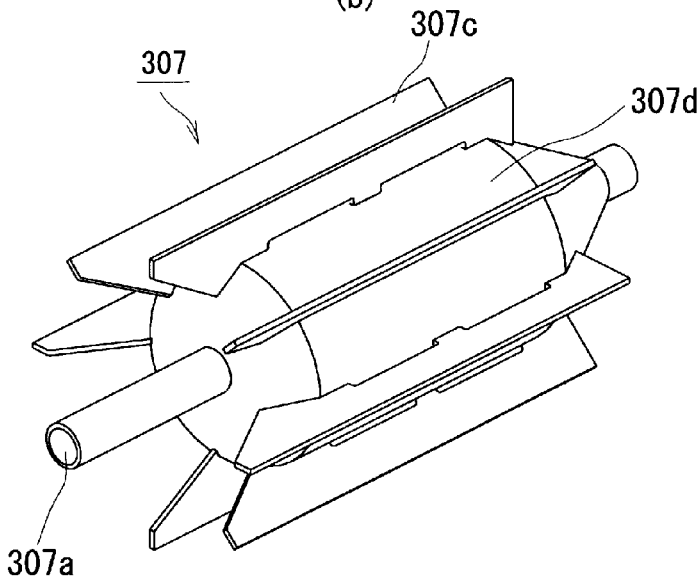
Figure 12:
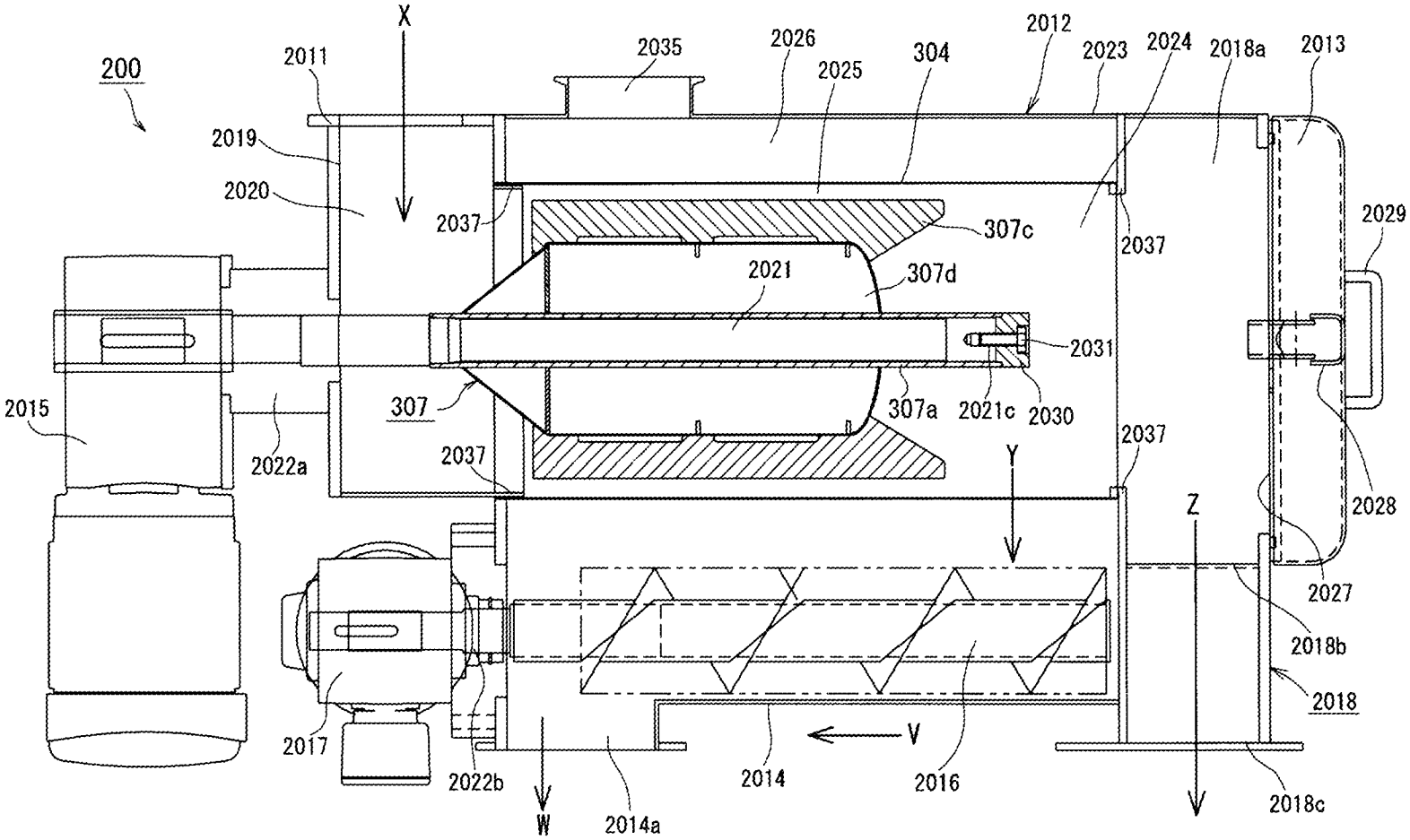
FIG. 12 is a partly-sectional front view of the internal structure of the cylindrical sifter including the stirring member of the modified example.

In one modified structure, the stirring member 207 may be replaced with a stirring member 307 shown in FIGS. 11 and 12. The stirring member 307 includes a rotating shaft 307*a* detachably mounted on the driveshaft 2021, a drum 307*d* fastened to the outer circumference of the rotating shaft 307*a*, and a plurality of blades 307*c* extended radially from the outer circumference and extended in the axial direction of the driveshaft 2021. Refer to the patent literature of WO2007/129478 for the detailed structure of this stirring member 307.

Figure 13:
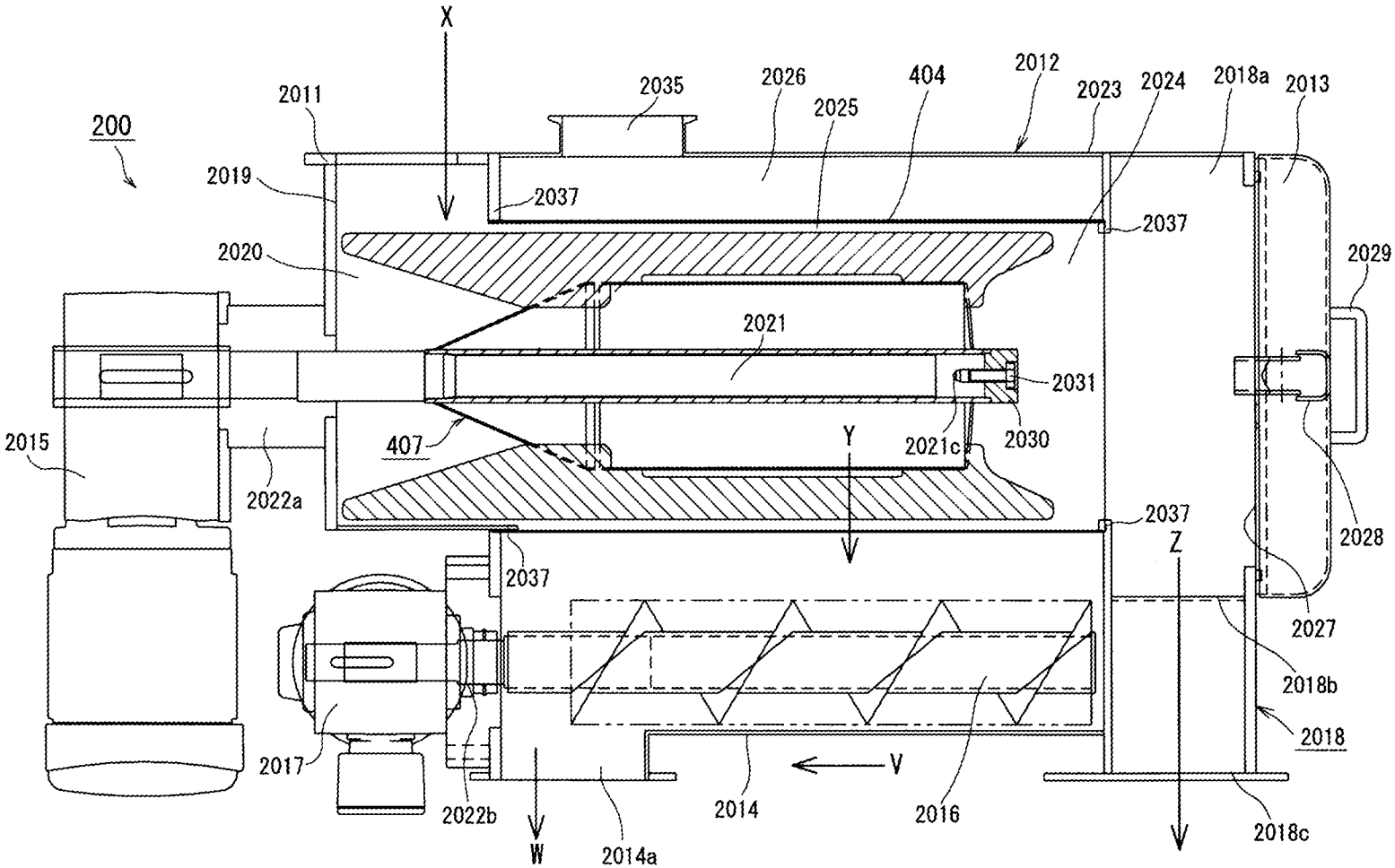
FIG. 13 is a partly-sectional front view of the internal structure of the cylindrical sifter including a stirring member of another modified example.

In another modified structure, the stirring member 207 may be replaced with a stirring member 407 having front ends of the blades 307*c* of the stirring member 307 extended to the supply chamber 2020 (FIG. 13). The number of blades may be changed as appropriate. The blades may be inclined to the axial direction of the rotating shaft.

The above embodiments are to be considered in all aspects as illustrative and not restrictive. There may be many modifications, changes, alterations as well as the equivalency, without departing from the scope or spirit of the main characteristics of the present invention. All such modifications and changes that come within the meaning and range of equivalency of the claims are to be embraced within their scope.

For example, three plate arms 3*a* may be arranged radially at intervals of 120 degrees along the circumference, instead of the four plate arms 3*a* arranged radially at the intervals of 90 degrees along the circumference. The inner ring 3*b* may be formed in an arc shape, instead of the ring shape. The cylindrical sieve 1 of the embodiment has the two support members 3 arranged at the preset interval in the axial direction. The cylindrical sieve may have any other number of the support members 3. The sieve body 4 is preferably made of a metal material having both rigidity and elasticity but may be made of any other material, such as ceramic material or plastic material. The cylindrical sieve 1 is assembled by welding in the above embodiment but may be assembled by any other suitable technique, for example, by using screws or other fasteners. The shape of the apertures 5 is not restricted to oval but may be any other suitable shape, such as rectangular.

INDUSTRIAL APPLICABILITY

The present invention provides a cylindrical sieve and a cylindrical sifter having enhanced sieving efficiency of the granular material and is applicable to a wide variety of fields including food industry, pharmaceutical industry, and chemical industry.

The invention claimed is:

1. A cylindrical sieve, comprising:

a cylindrical sieve body made from a corrugated plate having wave crests formed along an axial direction of the cylindrical sieve and wave troughs formed along the axial direction of the cylindrical sieve, said wave crests and said troughs being arranged alternately along a circumference of the cylindrical sieve, wherein a large number of apertures having an oval shape with a longitudinal axis aligned in the axial direction of the cylindrical sieve are formed in the corrugated plate;

the respective apertures are formed in an identical shape and in identical dimensions;

the apertures are formed evenly over the sieve body;

the horizontal to vertical ratio of the apertures is in range of 2:1 to 10:1;

the sieve body has an aperture ratio of 30 to 60%;

the apertures are arranged such that the longitudinal axes of the respective oval apertures are arrayed in the axial direction of the rotating shaft, one array of the apertures is shifted in position in the axial direction from an adjacent array of the apertures.

2. The cylindrical sieve of claim 1, wherein the oval shape comprises a pair of parallel linear edges and a pair of arcuate edges.

3. The cylindrical sieve of claim 1, wherein the apertures have a vertical dimension of between 3 and 3.4 mm (approximately between 0.1 and 0.13 inches) and horizontal dimensions of between 10 and 12 mm (approximately between 0.4 and 0.47 inches).

4. The cylindrical sieve of claim 1, wherein a diastance between central axes of the adjacent apertures is between 4 and 8 mm (approximately between 0.2 and 0.3 inches) in the vertical direction and between 13 and 15 mm (approximately between 0.51 and 0.59 inches) in the horizontal direction.

* * * * *